US009380882B2

(12) United States Patent
Murphy et al.

(10) Patent No.: US 9,380,882 B2
(45) Date of Patent: Jul. 5, 2016

(54) MATTRESS WITH USER ADJUSTABLE COMFORT FEATURES

(71) Applicants: Harrison Robert Murphy, Great Falls, VA (US); Juraj Michal Daniel Slavik, II, McLean, VA (US)

(72) Inventors: Harrison Robert Murphy, Great Falls, VA (US); Juraj Michal Daniel Slavik, II, McLean, VA (US)

(73) Assignee: KICKBALL CONCEPTS, LLC, Sterling, VA (US)

( * ) Notice: Subject to any disclaimer, the term of this patent is extended or adjusted under 35 U.S.C. 154(b) by 0 days.

(21) Appl. No.: 13/623,486

(22) Filed: Sep. 20, 2012

(65) Prior Publication Data

US 2014/0075678 A1 Mar. 20, 2014

(51) Int. Cl.

| | |
|---|---|
| ***A47C 17/00*** | (2006.01) |
| ***A47C 27/05*** | (2006.01) |
| ***A47C 31/00*** | (2006.01) |

(52) U.S. Cl.

CPC ..... *A47C 27/056* (2013.01); *A47C 31/001* (2013.01)

(58) Field of Classification Search

CPC .... A47C 31/105; A47C 27/15; A47C 31/007; A47C 27/05; A47C 27/056; A47G 9/00

USPC ..... 5/698, 699, 691, 737, 738, 901, 483, 5/484, 954

See application file for complete search history.

(56) References Cited

U.S. PATENT DOCUMENTS

| | | | | |
|---|---|---|---|---|
| 2,222,782 | A * | 11/1940 | Moses | 5/500 |
| 4,504,991 | A * | 3/1985 | Klancnik | 5/698 |
| 4,768,251 | A * | 9/1988 | Baskent | 5/722 |
| 4,955,095 | A * | 9/1990 | Gerrick | 5/691 |
| 6,098,224 | A | 8/2000 | Gladney | |
| 6,243,900 | B1 | 6/2001 | Gladney et al. | |
| 6,256,821 | B1 | 7/2001 | Boyd | |
| 6,490,744 | B1 | 12/2002 | Schulz, Jr. | |
| 6,643,876 | B2 | 11/2003 | Visser et al. | |
| 6,895,620 | B1 | 5/2005 | Rensink | |
| 6,922,862 | B1 * | 8/2005 | Thompson | 5/691 |
| 7,013,515 | B1 | 3/2006 | Price | |
| D523,277 | S * | 6/2006 | Contreras | D6/606 |
| 7,386,903 | B2 * | 6/2008 | Hochschild | 5/740 |

(Continued)

FOREIGN PATENT DOCUMENTS

JP 2012161394 A 8/2012

OTHER PUBLICATIONS

John McCormack, "Large scale standards testing (LST) Mattresses, Upholstered Furniture and Barrier Fabrics", presentation to National Institute of Standards and Technology, Mar. 18, 2009.

(Continued)

*Primary Examiner* — Timothy D Collins
*Assistant Examiner* — Richard G Davis
(74) *Attorney, Agent, or Firm* — Dentons US LLP

(57) ABSTRACT

A mattress wherein a plurality of independent yarn based fire barrier fabrics encases a plurality of distinct and unattached interior core structures. The plurality of interior core structures include at least a detached and internally flippable upper comfort layer assembly with a plurality of non-homogeneous foams or filling materials encased in a yarn-based fire barrier fabric and a lower, interiorly disposed support core structure with resilient filling materials encased in a yarn-based fire barrier fabric and a fabric cover. The detachable and internally flippable upper comfort layer assembly may be contained in a user accessible compartment that is fashioned into an outer cover assembly.

15 Claims, 5 Drawing Sheets

(56) References Cited

U.S. PATENT DOCUMENTS

| | | | | |
|---|---|---|---|---|
| 7,418,753 | B2 | 9/2008 | Kuchel et al. | |
| 7,444,706 | B2 | 11/2008 | Gladney et al. | |
| 7,587,775 | B2 | 9/2009 | DeFranks et al. | |
| 7,617,556 | B2 | 11/2009 | Rensink | |
| 7,644,461 | B2 | 1/2010 | Lee | |
| 7,814,594 | B2 | 10/2010 | DeFranks et al. | |
| 8,181,293 | B2 | 5/2012 | Defranks et al. | |
| 2002/0112291 | A1 | 8/2002 | Barman et al. | |
| 2006/0288491 | A1 | 12/2006 | Mikkelsen et al. | |
| 2007/0067916 | A1* | 3/2007 | Poston | 5/691 |
| 2008/0005845 | A1* | 1/2008 | Moran Pfleger | 5/691 |
| 2008/0263774 | A1* | 10/2008 | Lee | 5/691 |
| 2008/0295251 | A1 | 12/2008 | Flippin | |
| 2009/0094755 | A1 | 4/2009 | Murphy et al. | |
| 2009/0126119 | A1 | 5/2009 | Ogle | |
| 2011/0067182 | A1* | 3/2011 | Kussoff | 5/698 |
| 2011/0094039 | A1* | 4/2011 | Tervo et al. | 5/691 |
| 2011/0283458 | A1* | 11/2011 | Gillette et al. | 5/698 |
| 2012/0036644 | A1* | 2/2012 | Lynn A47C | 27/00 5/698 |
| 2012/0047658 | A1 | 3/2012 | DeMoss et al. | |
| 2014/0123396 | A1* | 5/2014 | Fox et al. | 5/691 |

OTHER PUBLICATIONS

Hilado et al., "Relative flammability and toxicity of pyrolysis gases from cellular plastics", Journal of Cellular Plastics, Jul. 1979, vol. 15, pp. 205-210.

Ohlemiller et al. "Aspects of the fire behavior of thermoplastic materials", NIST Technical Note 1493, Jan. 2008.

Oxygen Index (BS 2782:141 & ISO 4589-2), University of Central Lancashire, http://www.uclan.ac.uk/schools/forensic_investigative/fire_hazards_science/equipment_tests/oxygen_index.php.

* cited by examiner

MATTRESS WITH USER ADJUSTABLE COMFORT FEATURES

BACKGROUND

The design, manufacture, and assembly of mattresses, mattress foundations, upholstered furniture articles and other articles filled with resilient cushioning materials has varied little in the history of these products. The primary areas of innovation have occurred with the introduction of new filling materials.

According to the International Sleep Products Association (ISPA), the domestic US mattress industry shipped mattresses and foundation units in 2010 totaling 34 million units or roughly 17 million sets of bedding with a retail value in excess of $11 billion.

Numerous filling materials are used to construct mattresses, mattress foundations, upholstered furniture articles and other articles filled with resilient cushioning materials. These can be made from, for example, foam, fiber or other similar resilient material.

Manufacturers of flexible polyurethane foam, textile fibers, and other resilient filling materials employ a wide variety of technical measurements to communicate the performance attributes engineered into particular foams. Such technical measurements include indentation force deflection (IFD), indentation load deflection (ILD), tensile strength, tear strength, density pounds per cubic foot (PCF), flex fatigue, denier, cut length, and basis weight.

Materials may be further differentiated by their composition. In the case of flexible polyurethane foams, for instance, there are visco-elastic foams, latex foams, gel-infused foams, memory foams, conventional foams, filled conventional foams, high resiliency (HR) foams, modified HR foams, combustion modified foams, melamine modified foams—all of which can be made at differing densities and hardnesses making the possible total number of combinations potentially limitless.

It is well known that flexible foam materials have demonstrably different levels of flame retardance. For instance, latex foam is highly flammable and therefore, presents a much more difficult fuel load to protect from open flame ignition sources than that of the fuel load of a standard polyurethane foam. The need for protection based on foam type impacts the manufacturers' selection of fire barrier materials.

During the last several years, U.S. mattress manufacturers have manufactured "one-sided" mattresses.

Using marketing that intimates that this is preferable to the consumer as they no longer have to "flip" their mattress, the fact is that the manufacture of a "one-sided", "non-flippable" mattress is both a sales growth and cost saving effort by manufacturers. It is a sales growth effort in that a two-sided mattress could reasonably be expected to have twice the useful life expectancy of the current one-sided units, so shortening the life span results in increase purchase frequency by consumers—a potential sales doubler. The cost cutting aspect is a result of removing the costly comfort delivering fillings on one-side of the mattress. Not surprisingly, retail price points for mattresses did not decline commensurately to reflect the life shortening and cost reductions when this product change occurred.

Much of the growth of one-sided mattresses began with the AB 603 mattress flammability standard in California and later reached near universal design adoption that coincided with the implementation of the Federal Mattress Flammability Standard 16 CFR 1633 in 2007. Many mattress manufacturers determined that typical, tape-edged and two-sided mattresses had a crown or convex surface profile on the panel planar surface of the mattress that when placed on a flat foundation structure created a crevice between mattress and foundation that present testing challenges. Removing one convex side from the mattress design eliminated the crevice and facilitated testing compliance.

The design evolution of mattresses away from two-sided constructions and toward one-sided constructions has several, potentially adverse implications for consumers that have not been effectively addressed by manufacturers.

The resilient cushioning materials used by mattress manufacturers to create the sleeping surface of the mattress and to afford the user a level of comfort while sleeping are prone to physical breakdown during use. This is referred to as "taking a set" and the mattress industry itself describes the presence of these body impressions as "normal". Over time, these body impressions do degrade the sleep experience and the benefits sought to be derived from the sleep experience. In a two-sided mattress, users were instructed to flip and rotate the mattress every several months to balance the occurrence of the impressions—in a traditionally designed one-sided, no-flippable mattress, this option to promote longevity is reduced. In fact, current marketing of mattresses touts the lack of "maintenance" required for one-sided mattresses.

Second, the traditional approach to mattress design has been to construct the product in such a manner as to preclude the end-user from being able to access interior components of the mattress. As the cushioning materials physically breakdown, the end-user is left with no alternative but to replace the entire mattress assembly in order to rectify the body impressions condition. Given that conventional end-of-life-cycle disposal of mattresses has been to place them in landfills, the increasing pace at which the one-sided mattress design can be expected to result in disposal and replacement, the potential waste-stream impact of the one-sided mattress in potentially substantial.

While the retail mattress world has been flocking to the one-sided mattress design, one arena where two-sided mattresses still find wide acceptance is in college dormitory environments. Since institutional purchasers, such as college and university residence life operations, view residence hall mattresses as an asset whose value is enhanced with longer service life, the ability to flip mattresses with a two-sided traditional mattress design has remained desirable.

Some two-sided institutional mattress designs promote the benefit of a dual firmness design, wherein the filling materials selected for one of the two sides is chosen to be "soft" and the other side's materials are chosen to be "firm", thereby permitting the end-user to custom select their preferred sleep surface.

The invention captures the benefits of both the one-sided design and the dual-firmness design approach of certain two-sided mattresses simultaneously, and does so in a manner that can afford environmentally conscious end-users with the ability to reduce the waste stream impact of disposal of mattresses when filling materials degrade after their useful life expectancy. Since the upper comfort layer assembly is accessible to the end-user, the foam or filling materials may be replaced when, through the normal course of use or in the event of damage, the end-user wishes. The ability to replace only the upper comfort layer foam or filling materials and the fire barrier that encases them, while preserving for use the remaining mattress components results in a lessened disposal impact. Additionally, the detachable cover assembly itself may be replaced if worn or soiled, again permitting the preservation of the remaining, still serviceable mattress components and lessening the disposal impact.

The invention further delivers the benefit of material design flexibility as it relates to fire barrier selection, especially in the case of knitted, tubular fire barriers, to meet requirements of full-scale fire testing, such as 16 CFR 1633. Heretofore, conventional mattress design approaches have elected to substantially encase the entire mattress structure in fire barrier material capable of addressing the worst-case flammability profile of components or filling materials selected for construction of the mattress. For instance, if a mattress design used a combination of highly flammable materials, such as latex foam, in conjunction with materials that were less flammable, such as standard polyurethane foam or foams that are moderately combustion modified, then the barrier would likely have to be chosen from a more robust, therefore heavier and more expensive fire barrier design that could address the flammability profile of the worst-case component—in this case latex foam. The invention, through its use of a plurality of fire barriers, provides the potential to tailor the fire barrier selection to each specific region of the mattress and its associated propensity to ignite when exposed to an open-flame ignition source, and therefore achieve material efficiencies not afforded by pre-existing design approaches. The use of a plurality of independent fire barrier systems allows the flexibility of design that enables the targeted selection fire barriers to address the specific and potentially disparate flammability characteristics for various elements of the present invention

BRIEF SUMMARY

The invention provides for an improved mattress that may be sold alone to an end-consumer or in a set of bedding with a traditional foundation.

In one embodiment, a mattress is formed from a lower, interiorly disposed support core structure and detachable cover assembly. The lower, interiorly disposed support core structure is constructed of a foam encased innerspring unit that is encased entirely by a yarn-based knitted fire barrier fabric or sock. The fire barrier encased core assembly is then enclosed in a fabric cover that is sewn closed. The detachable and internally flippable upper comfort layer assembly is contained in a user accessible compartment that is fashioned into an outer cover assembly which is tailored to also encase the lower, interiorly disposed support core structure. The detachable and internally flippable upper comfort layer assembly is comprised of a plurality of non-homogeneous foams or filling materials and is itself partially or fully encased in a yarn-based knitted fire barrier fabric or sock. According to the instant invention, the fire barrier fabrics or socks used to independently encase the lower, interiorly disposed support core structure and the upper comfort layer assembly may be identical. However, the disparate flammability resistance properties expected from the use of non-homogeneous foams or resilient filling materials will likely dictate the use of fire barrier fabrics or socks which have differing degrees of flame resistant properties.

BRIEF DESCRIPTION OF THE DRAWINGS

The invention will be described in conjunction with the following drawing in which like reference numerals designate like elements and wherein.

DETAILED DESCRIPTION

Figure 1:
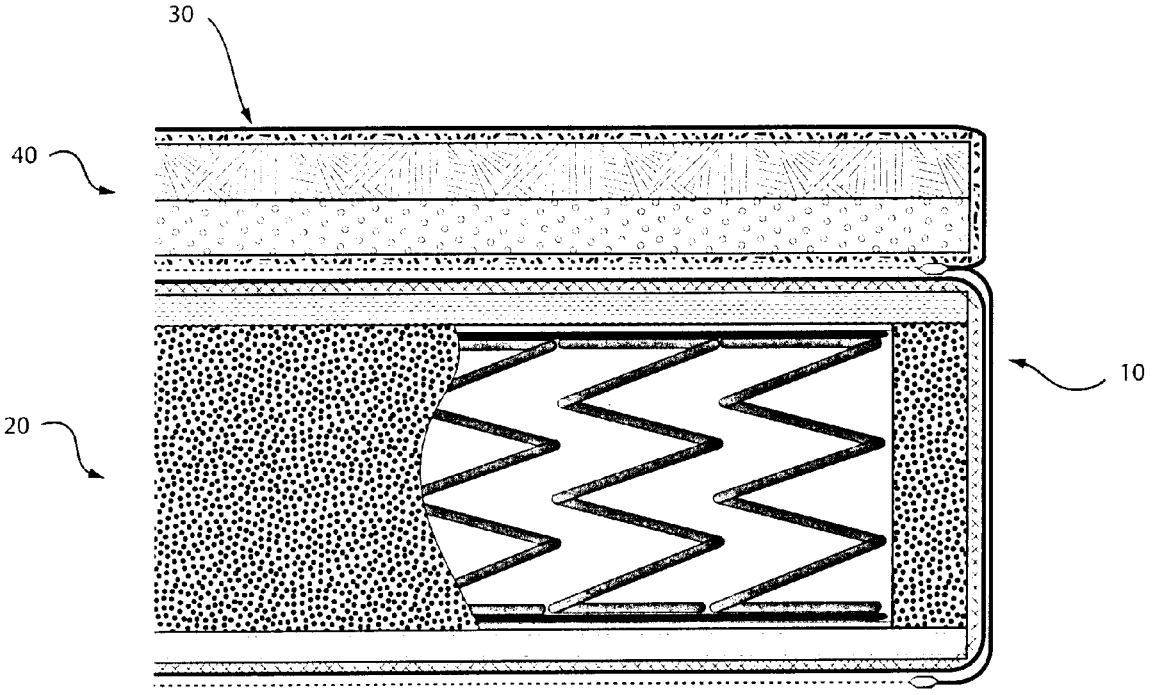
FIG. 1 is a cross-sectional view providing an overview of the mattress construction, which shows a lower, interiorly disposed support core structure, a removable cover system, and an upper comfort layer core assembly.

Certain embodiments of the invention will be described and illustrated in detail, however, it will be apparent to those of skill in the art that other embodiments of the invention are realizable and that the embodiments illustrated and described herein are not meant to limit the scope of the invention.

A mattress and terms relating to mattresses are defined below and conform to the terms as defined by 16 C.F.R. 1632, the entire contents of which are incorporated herein by reference. Additionally, the terms defined below conform to the terms as defined in the NPR on Mattress Flammability of 16 CFR 1633 as approved by the CPSC on Feb. 16, 2006, the entire contents of which are incorporated herein by reference.

A mattress refers to a ticking filled with a resilient material used alone or in combination with other products intended or promoted for sleeping upon. Examples include but are not limited to adult mattresses; youth mattresses; crib mattresses such as portable crib mattresses; bunk bed mattresses; futons; water bed; air mattresses which have upholstery material between the ticking and the mattress core; and any detachable mattresses used in any item of upholstered furniture such as convertible sofa bed mattresses, corner group mattresses, day bed mattresses, roll-a-way bed mattresses, high risers, and trundle bed mattresses. A mattress may also be called a bed.

For purposes of this disclosure, a mattress does not include sleeping bags; pillows; mattress foundations; liquid and gaseous filled tickings such as water beds and air mattresses which do not have upholstery material between the ticking and the mattress core; upholstered furniture which does not have a detachable mattress such as chaise lounges, drop-arm love seats, press-back lounges, push-back sofas, sleep lounges, sofa beds (including jackknife sofa beds), sofa lounges (including glide-outs), studio couches and studio divans (including twin studio divans and studio beds); and juvenile product pads such as car bed pads, carriage pads, basket pads, infant carrier and lounge pads, dressing table pads, stroller pads, crib bumpers, and playpen pads.

A mattress pad refers to a thin, flat mat or cushion, and/or ticking filled with resilient material for use on top of a mattress. Examples include, but are not limited to, absorbent mattress pads, flat decubitus pads, and convoluted foam pads, which are totally enclosed in ticking. For purposes of this disclosure, a mattress pad does not include foam pads, which are not totally encased in ticking.

Ticking refers to the outermost layer of fabric or related material that encloses the core and upholstery materials of a mattress or mattress pad. A mattress ticking may include, for example, several layers of fabric or related materials quilted together.

Core refers to the main support system that may be present in a mattress, such as springs, foam, hair block, water bladder, air bladder, or resilient filling. For purposes or this disclosure, a mattress may have a plurality of core structures.

Upholstery material refers to all material, either loose or attached, between the mattress or mattress pad ticking and the core of a mattress, if a core is present.

Tape edge (edge) refers to seam or border edge of a mattress or mattress pad.

Quilted refers to stitched with thread or by fusion through the ticking, and one or more layers of upholstery material.

Tufted refers to buttoned or laced through the ticking and upholstery material and/or core, or having the ticking and upholstery material and/or core drawn together at intervals by any other method which produces a series of depressions on the surface.

A mattress foundation is any surface such as foam, box springs or other, upon which a mattress is placed to lend it support for use in sleeping upon.

An article of upholstered furniture is a resilient filling material that may optionally be supported by a frame or structure and is encased by a textile structure. The article of upholstered furniture is intended to be used for sitting or reclining but is not primarily intended for sleeping and conforms to the term as defined by the draft language of 16 C.F.R. 1634, as published by the CPSC in May 2005, the entire contents of which are incorporated herein by reference.

A textile structure is any type of material made from fibers or other extended linear materials such as thread or yarn. Classes of textile structures include woven fabrics, knitted fabrics, crocheted fabrics, knotted or tufted cloth and non-woven fabrics, such as felt, high loft, spunlaced, stitch-bonded, hydroentangled, air laid or needle punched fabrics. A textile structure also encompasses composites of multiple textile structures that may include the foregoing textile classes.

FIG. 1 is an illustration in the form of a cross-sectional view of a mattress assembly 10 of an embodiment of the invention with a lower, interiorly disposed support core structure 20, a detachable cover assembly 30 and an upper comfort layer core assembly 40.

Figure 2:
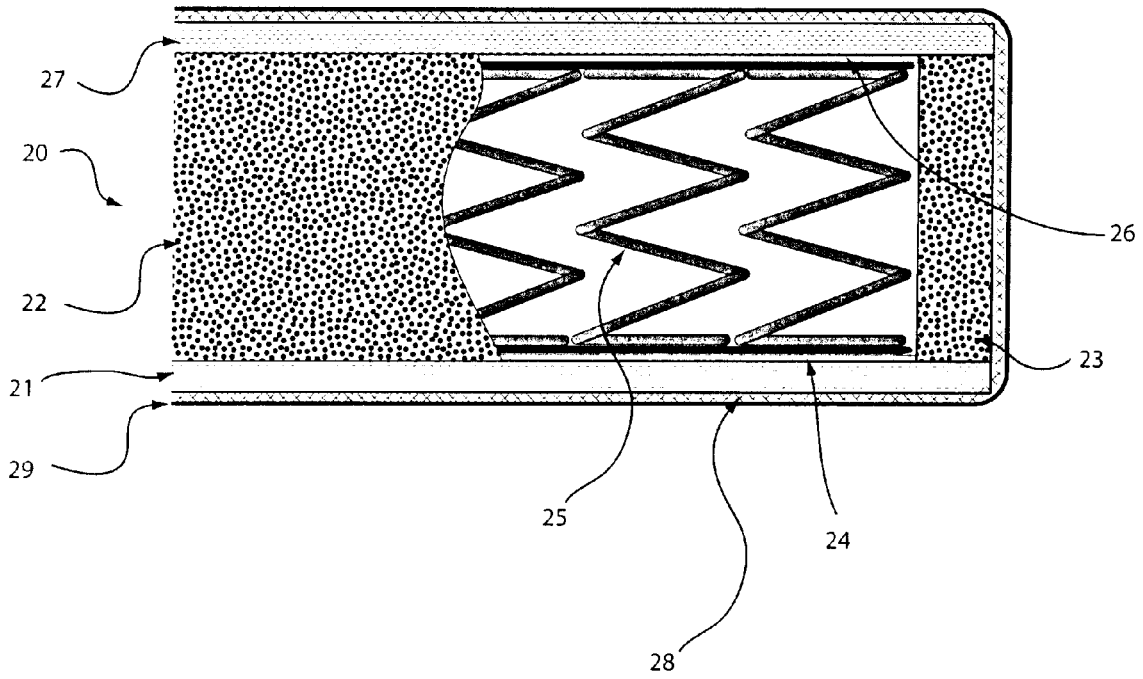
FIG. 2 is a cross-sectional, detailed view of the lower, interiorly disposed support core structure.

FIG. 2 is an illustration in the form of a cross-sectional view of the lower, interiorly disposed support core structure 20. Measurements provided are for reference and are not intended to be limiting in the present invention as it is contemplated that measurements of selected materials may be adjusted to meet construction requirements or material costing requirements. An embodiment of the lower, interiorly disposed support core structure 20 for a twin-sized mattress illustrated in FIG. 2 includes the following:

A base slab of polyurethane foam 21 measuring approximately 38" wide by 74" long by 1½" thick. The selected foam may be standard polyurethane foam with a 1.8 density and an ILD of between 25 and 45.

Side rails 22 measuring approximately 68" long by 1½" wide by 4" tall and head/foot rails 23 measuring approximately 38" long by 3" wide by 4" tall affixed, e.g., glued, to the slab 21 and to each other at the corners to create a foam encasement cavity structure with one open side. Standard polyurethane foam with a 1.8 pound density and an ILD of greater than 40 may be used. The type of glue used or the possible selection of alternative methods of attaching the foam pieces 21, 22, and 23 to one another is not limited by the invention.

A non-woven textile 24 measuring approximately 35" wide by 68" long may be provided inside the foam encasement cavity structure, in contact with the exposed face of slab 21. Textile 24 mitigates or prevents penetration of the foam encasement surface, especially base slab 21 or lid 27, by the innerspring unit that is installed inside the foam encasement cavity structure in this embodiment. Alternatively, a pad made of recycled textile and foam remnants known as a "shoddy" pad may be used; however the omission of this textile 24 or alternatives is contemplated by the invention.

An innerspring assembly 25 of conventional design measuring approximately 35" wide by 68" long and 4" tall may be provided inside the foam encasement cavity structure and atop the textile 24. The particular design of the innerspring is not a limiting feature of the invention and it is fully contemplated that the use of unconventional innerspring designs or even the omission of the innerspring entirely and its replacement with alternative filling materials that occupy the cavity of the foam encasement structure fall within the scope of the invention.

A non-woven textile 26, similar to 24, may be provided atop the installed innerspring assembly 25. Textile 26 mitigates or prevents penetration of the foam encasement surface, especially base slab 21 or lid 27, by the innerspring unit that is installed inside the foam encasement cavity structure in this embodiment of the invention. Alternatively, a pad made of recycled textile and foam remnants known as a "shoddy" pad may be used; however the omission of this textile 24 or alternatives is contemplated by the invention.

A lid 27 or base slab 21 of polyurethane foam measuring approximately 38" wide by 74" long by 1½" thick may be affixed, e.g., glued to top surfaces of side rails 22 and head/foot rails 23. The selected foam may be standard polyurethane foam with a 1.8 density and an ILD of between 25 and 45. The type of glue used and alternative methods of attaching the foam pieces 27, 22 and 23 to one another is not limited by the invention.

The lid 27 or slab 21 is affixed, e.g., glued, onto the foam encasement cavity structure, which completes the formation of a foam encased innerspring. However, a core completely comprised of foam, for instance a foam block measuring approximately 38" wide by 74" long by 7" thick, is an alternative embodiment that is contemplated by the invention.

A knitted, tubular, yarn-based fire barrier 28, specifically, 130® Barrier Style 5041 as sold by Ventex, Inc. of Great Falls Va., may be cut to fit the block and then sewn closed at one end with Kevlar® thread, pulled over the foam core block and sewn closed at the opposite end with Kevlar® thread. This particular fire barrier 28 may be comprised of fiberglass and flame retardant rayon fibers, however the invention fully contemplates the use of alternative fibers and yarns to fabricate the fire barrier, including the following: aramids, including para-aramids (poly(p-phenylene terephthalamide), e.g., KEVLAR®. (Dupont Corporation) and TWARON® (Teijin Twaron, BV) and meta-aramids (poly(m-phenylene isophthalamide), such as Nomex® (Dupont Corporation); fiberglass; melamines such as BASOFIL® (BASF); poly-benzimidazole (PBI) (Celanese Acetate A.G); oxidized polyacrylonitrile (PAN); novoloids, such as KYNOL® (American Kynol, Inc); pre-oxidized fibers and carbon fibers, modacrylics, such as, e.g., KANECERON®. and PROTEX® (Kaneka), FR (fire- or flame-resisting, -resistant, -retarding or -retardant) rayon, FR viscose, such as, e.g., LENZING FRO (Lenzing AG, Fibers Division) and VERIFIBER® TCF FR Rayon Fiber (Ventex, Inc.), wool and FR-treated cotton. It should be noted that these fibers are merely exemplary, and other fire-retardant fibers may be used.

Additionally, certain proprietary modacrylic fibers that release extinguishing/oxygen depriving elements such as antimony when exposed to an ignition source may be used. This chemical reaction may assist in snuffing out small flames that may occur on adjacent, non-FR components such as the mattress covering fabric or ticking Blends that include at least one fire-retardant fiber that form a char may also be used. The blends may include one or more structure-providing char-forming fire-retardant fibers, FR-treated fibers, such as FR-treated polyester, and non-FR fibers. Non-flame-resistant polyester may be used as a carrier fiber for manufacturing fiberglass fabrics, and these fabrics may have 10% of a polyester fiber, and up to 50% of that fiber. Furthermore, while preference is given to use of inherently flame retardant yarns and fibers in the fabrication of the yarn-based fire barrier 28, the use of chemical treatments to achieve flame retardant performance is fully contemplated.

Following the closure of the fire barrier sleeve or sock 28, a cover assembly 29 may be provided to fully enclose and complete the lower, interiorly disposed support core structure 20. In this embodiment, the fabric may be a polyurethane coated nylon fabric sold as SOFlux OX-V® HF (Ventex, Inc.). This cover assembly is sewn closed, however the use of sealable fabrics is fully anticipated in this invention. Furthermore, the selection of fabric used to fashion the cover assembly 29 is open to the design requirements of the finished mattress and its intended use profile. The broadest selection of fluid and pest (including, but not limited to bed bugs, dust mites, or lice) impervious fabrics is contemplated, as is the use of anti-microbial, anti-fungal or anti-bacterial finishes and treatments on the fabric. Alternative embodiments are contemplated that do not utilize fabrics for cover assembly 29 with fluid resistant properties or material impervious finishes, however the omission of such features would reduce potential benefits contemplated by the invention.

Contemplated and executed alternative embodiments to the instant invention used a fabric cover assembly 29 made from Recovery5™ Healthcare Fabric (Ventex, Inc.), a fluid resistant and heat-sealable fabric, made from a polyurethane film that is transfer coated or laminated to a knitted polyester substrate. The cover may be heat sealed to create a cover that is impervious to fluid ingress or bed bug ingress into the lower, interiorly disposed support core structure 20.

Figure 3:
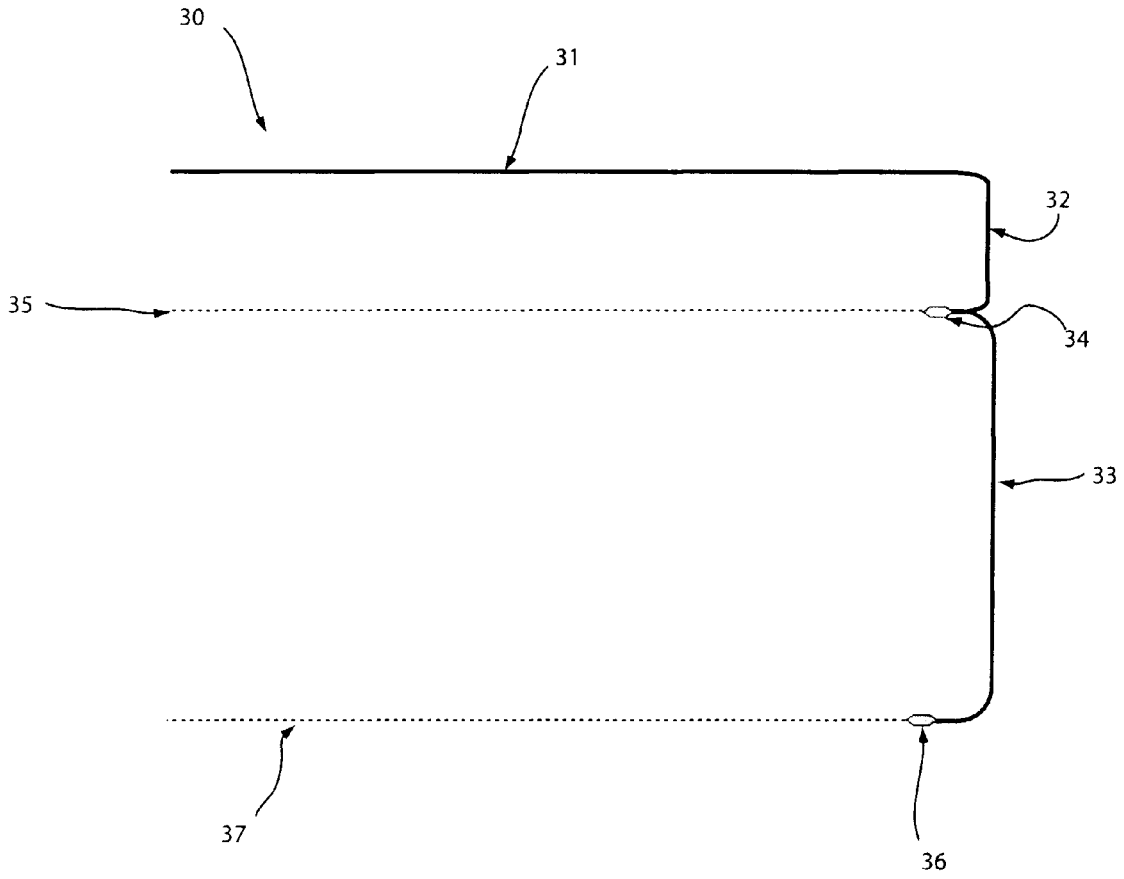
FIG. 3 is a cross-sectional, detailed view of the removable cover system.

FIG. 3 is an illustration in the form of a cross-sectional representation of the detachable cover assembly 30 according to a second embodiment of the invention. By way of example, the detachable cover assembly 30 for a twin-sized mattress may be constructed as follows:

A knitted, fabric ticking 31 Nuvola™ Halogen Free Style CT0806 (Creative Ticking, LLC) may be used to create an upper compartment 32 to house the upper comfort layer core assembly (not shown in this figure).

The upper compartment 32 may be completed by joining the interior textile 35, a stitch bonded, TCF Rayon Filler Cloth 35, to the ticking 31 by means of a zipper 34 that transits the entire perimeter of the seam between the two materials. The zipper 34 may be internally disposed to the construction of the detachable fabric cover 30, and as such would not be visible to the outside of the mattress 10 assembly. In this embodiment, the zipper 34 joins the interior textile 35 along the entire interior perimeter of the planar surface of the mattress; however the joining of the ticking 31 to interior textile 35 may be accomplished with a combination of a zipper or similar closing system and sewn seams. Note, the zipper, seams or any other joining areas between the ticking 31 and interior textile 35 are located inside the cover and are not be visible from the outside of the cover.

An additional section of fabric ticking 31 may be provided to descend vertically along the border of the mattress from the lower, outside visible seam line of the upper compartment 32 and create the lower compartment 33 that houses the lower, interiorly disposed support core structure (not shown in this figure) and is joined to the non-slip bottom fabric 37 of the cover assembly 30. The non-slip bottom fabric 37 may be joined to the fabric ticking 31 of the lower compartment 33 by means of a zipper 36. The zipper 36 may be disposed outside the detachable fabric cover 30, and as such would be visible to the outside of the mattress 10 assembly. However, the zipper 36 is preferably provided on the planar face of the mattress that rests atop the mattress foundation or other similar support structure. In this embodiment, the zipper 36 joins the non-slip bottom fabric 37 along the entire interior perimeter of the lower planar surface of the mattress; however the joining of the ticking 31 to the non-slip bottom fabric 37 may be accomplished by a combination of a zipper or similar closing system and sewn seams. Note, the zipper, seams, or any other joining areas between the ticking 31 and the non-slip bottom fabric 37 are located inside of the cover and are not necessarily visible from the outside of the cover.

Figure 4:
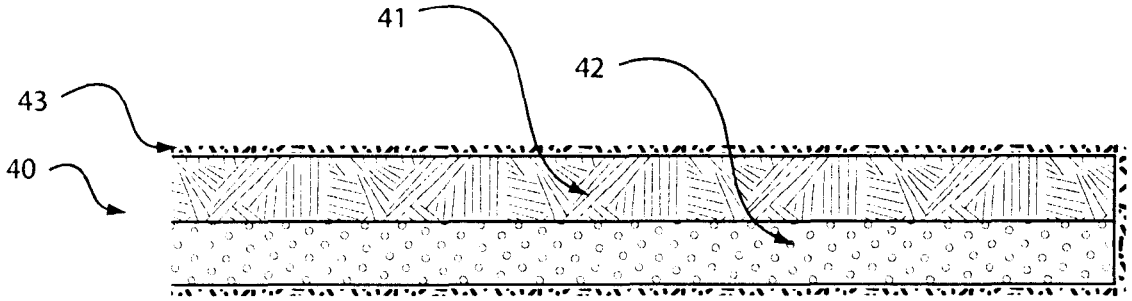
FIG. 4 is a cross-sectional, detailed view of the upper comfort layer core assembly.

FIG. 4 is an illustration in the form of a cross-sectional representation of the upper comfort layer core assembly 40 according to an embodiment of the invention. By way of example, the upper comfort layer core assembly for a twin-sized mattress may be constructed as follows:

A first comfort layer slab of foam 41 measuring 38"×74"×2" is provided. The foam 41 may be selected from latex rubber foam with a density of greater than 4.0 pounds and an ILD of between 10 and 25 and an LOI of less than 30.

A second comfort layer slab of foam 42 measuring 38"×74"×2" is provided. The second piece of foam 42 may be selected from standard polyurethane foam with a density of 1.8 pounds and an ILD of 30 and an LOI of less than 30.

The first comfort layer slab of foam 41 and the second comfort layer slab of foam 42 are glued together along the planar faces of the two slabs. For purposes communicating the benefits of the invention clearly, only two pieces of foam are used in the detailed description herein; however it is contemplated that more than two non-homogeneous types of foam or other resilient filling materials could be employed in alternative embodiments.

The joined pieces of foam 41 and 42 are then encapsulated in a knitted, tubular, yarn-based fire barrier 43, specifically, K1™ Barrier Style 6377, a halogen-free, para-armid based fire barrier as sold by Ventex, Inc. of Great Falls Va., which is cut to fit the block and then sewn closed at one end with Kevlar® thread, pulled over the foam core block and sewn closed at the opposite end with Kevlar® thread. This particular fire barrier 43 is comprised of para-aramid fiber and flame retardant rayon fibers, however the invention fully contemplates the use of alternative fibers and yarns to fabricate the fire barrier, including the following: aramids, including para-aramids (poly(p-phenylene terephthalamide), e.g., KEVLAR®. (Dupont Corporation) and TWARON® (Teijin Twaron, BV) and meta-aramids (poly(m-phenylene isophthalamide), such as Nomex® (Dupont Corporation); fiberglass; melamines such as BASOFIL® (BASF); poly-benzimidazole (PBI) (Celanese Acetate A.G); oxidized polyacrylonitrile (PAN); novoloids, such as KYNOL® (American Kynol, Inc); pre-oxidized fibers and carbon fibers, modacrylics, such as, e.g., KANECERON®. and PROTEX® (Kaneka), FR (fire- or flame-resisting, -resistant, -retarding or -retardant) rayon, FR viscose, such as, e.g., LENZING FR® (Lenzing AG, Fibers Division) and VERIFIBER® TCF FR Rayon Fiber (Ventex, Inc.), wool and FR-treated cotton.

It should be noted that these fibers are merely exemplary, and other fire-retardant fibers, including fibers that are developed in the future may be used. Additionally, certain proprietary modacrylic fibers that release extinguishing/oxygen depriving elements such as antimony when exposed to an ignition source may be used. This chemical reaction may assist in snuffing out small flames that may occur on adjacent, non-FR components such as the mattress covering fabric or ticking Blends that include at least one fire-retardant fiber that form a char may also be used. The blends may include one or more structure-providing char-forming fire-retardant fibers, FR-treated fibers, such as FR-treated polyester, and non-FR fibers. Non-flame-resistant polyester may be used as a carrier fiber for manufacturing fiberglass fabrics, and these fabrics may have 10% of a polyester fiber, and up to 50% of that fiber. Furthermore, while preference is given to use of inherently flame retardant yarns and fibers in the fabrication of the yarn-based fire barrier 43, the use of chemical treatments to achieve flame retardant performance is fully contemplated.

Figure 5:
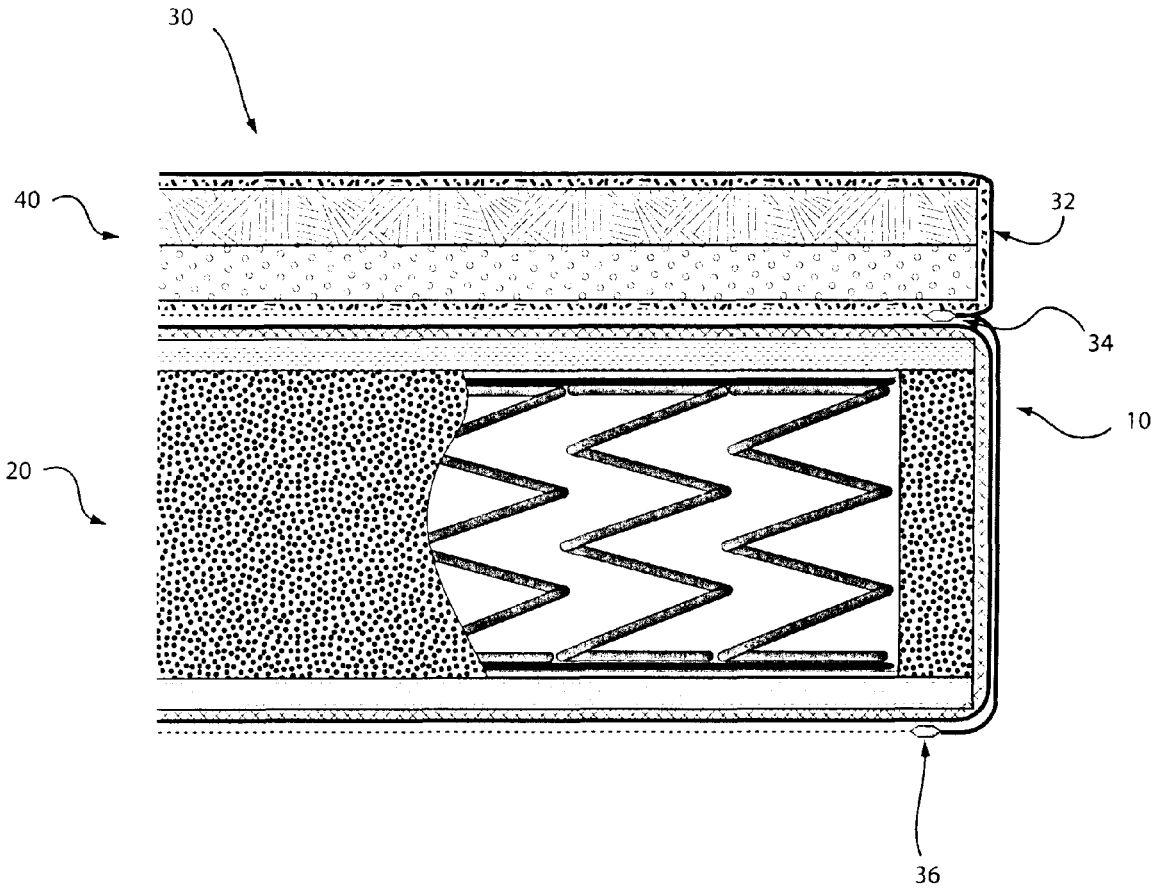
FIG. 5 is a cross-sectional, detailed view of the finished mattress according to an embodiment of the invention.

FIG. 5 illustrates a final assembly of the mattress according to an embodiment of the invention. By way of example, the embodiment may be constructed as follows:

The upper comfort layer core assembly 40 may be installed into the upper compartment 32 of the detachable cover assembly 30, and the zipper 34 is closed.

The detachable cover assembly 30 may then installed over the lower, interiorly disposed support core structure 20, and the zipper 36 is closed.

The finished mattress 10 may be installed atop a foundation.

The illustrated embodiment of the invention is for a twin sized specimen with finished exterior dimensions measuring approximately 39" wide by 75" long by 11" high or thick. All other sizes of mattresses and foundations are contemplated as being able to enjoy the benefits of the invention described herein. Furthermore, it is fully contemplated that larger sized mattresses, e.g. Queen and King sized mattresses, may be fashioned from all possible combinations that would employ one or more lower, interiorly disposed support core structures 20 and one or more upper comfort layer core assemblies 40 encased in a single detachable cover assembly 30.

The mattress of the invention departs significantly from the prior art. For example, the detachable nature of the cover assembly 30 and accessibility of the upper compartment 32 allows the end user to flip the upper comfort layer core assembly 40 to suit their personal preference for a sleeping surface. For instance, one criticism of some visco-elastic memory foams and latex foams is that they exhibit higher levels of heat build-up from sleeping bodies and therefore sleep "hotter" than other types of foam, whereas newer, gel-infused foams have been designed to deliver a "cooling" effect. The design flexibility in the invention permits seasonal adjustment to sleeping temperature simply through planar rotation or "internally flipping" the upper comfort layer core assembly 40.

Furthermore, when the upper comfort layer core assembly 40 begins to exhibit signs of wear or "taking a set", the end user may replace the assembly without discarding the remainder of the mattress components.

However, this design flexibility must comply with full-scale flammability testing. The choice of fire barrier 43 is critical to the ability of the mattress to meet the requirements of full-scale open flame fire testing. Since the invention is not limiting with regards to the particular types of foams or other filling materials that may be used in positions occupied by foam slabs 41 or 42, it is contemplated that they could be of significantly disparate levels of flame retardance.

It is well-known that the selection of foam or fibrous filling materials can impact the composite article's ability to withstand an open flame ignition source and therefore comply with full-scale fire test protocols such as 16 CFR 1633, California Technical Bulletin #603 (TB603), California Technical Bulletin #129 (TB129), or Boston Fire Department IX-11 (BFDIX-11), all of which are incorporated in their entirety by reference.

For the purposes of the invention, it is desirable to identify the disparate propensities to ignite for such materials into a four level classification schema, such as that found in Table 1.

TABLE 1

Classification Scheme for Degree of Flammability for Mattress Foams and Filling Materials

| Level | Relative Degree of Expected Flammability | Examples |
|---|---|---|
| A | Highly flammable | Latex Foam/Gel |
| B | Moderately Flammable | Gel-Infused Foam, Visco-Elastic Memory Foam |
| C | Mildly Flammable | Standard Polyurethane Foam, Slickened polyester fiber batting |
| D | Combustion Resistant | Foams treated with Flame Retardant. Unslickened (dry) polyester fiber batting, wool, |

In order to optimize the mattress design, with respect to the selection of the fire barriers, it is important to understand the relative protective levels of the barrier or barrier system, which may typically be achieved by a review of the material or system basis weight as measured in ounces per square yard of textile material. One example of a possible classification scheme for the fire barrier selection may be found in Table 2. The appropriate selection is intended to promote the ability of the composite article to pass the required fire test.

TABLE 2

Classification Example for Fire Barrier Selection

| Level | Relative Degree of Flammability Protection | Aggregate Basis Weight |
|---|---|---|
| 1 | Highest Performing | >7.0 oz per square yd |
| 2 | Strong Performing | 5.0 to 7.0 oz per square yd |
| 3 | Medium Performing | 3.5 to 5.0 oz per square yd |
| 4 | Minimum Performing | 1.0 to 3.5 oz per square yd |

One methodology contemplated by the invention would be to match a fire barrier selection to a foam or filling material selection based on the relative standing within such classification schemes. It would be anticipated that matching scheme proposed in Table 3 would deliver desirable outcomes when the composite is subjected to full-scale testing as mandated by law or regulation.

TABLE 3

Scheme For Matching Appropriate Fire Barrier to Foam or Filling Material

| | Fire Barrier Level | | | |
|---|---|---|---|---|
| Foam Class | 1 | 2 | 3 | 4 |
| A | Yes | No | No | No |
| B | Yes | Yes | No | No |
| C | Yes | Yes | Yes | No |
| D | Yes | Yes | Yes | Yes |

As the invention provides for the use of a plurality of non-homogeneous foams or other filling materials in the upper comfort layer core assembly 40, the selection scheme for matching barrier to filling material selection would require the selection of the fire barrier level matched to the presence of the highest foam or filling class. For example, if a slab of latex foam (Class A) were glued to a slab of flame retardant treated foam (Class D) then the appropriate fire barrier selection for this element would be a Level 1. However, if the slab of latex were replaced by a slab of gel-infused foam (Class B) the fire barrier selection could be reduced to a Level 2 barrier. In any such event, the fire barrier selection for the upper comfort layer core assembly 40 would be separate from the fire barrier selection process for the lower, interiorly disposed support core structure 20, since that barrier selection would be determined by the particular material selections for that region of the mattress 10.

For purposes of the invention, the distinction or description of foams or filling materials as being "non-homogeneous" is intended to convey the inventors' intent that foams or filling materials of identical material composition but dissimilar physical properties, e.g., density, ILD, or color, would be deemed to be "non-homogeneous." Similarly, foams or filling materials that are selected with identical physical properties but dissimilar material composition would also be deemed to be "non-homogeneous." For purposes of clarity, it is contemplated by the invention that "non-homogeneity" may be achieved merely by a difference on only one attribute of the intended foam or filling material, be it a compositional, physical or structural basis.

The benefits of a design approach that promotes user adjustment of comfort features to suit their personal preferences in concert with delivering a replacement strategy for worn or used parts that results in reduced waste stream impact and allows tailoring of fire barrier selections to the specific fuel loads and propensities of foams and resilient filling materials to ignite when exposed to open flame ignition sources is not only contemplated as described herein to be applicable to mattresses, but is anticipated to be applicable to upholstered furniture articles, transportation seating and upholstered articles, and contract furnishing articles as well.

What is claimed is:

1. A mattress comprising:

a flippable comfort layer assembly comprising:

a first layer of foam or filling material; and a second layer of foam or filling material, wherein the foam or filling material of the second layer is different from the foam or filling material of the first layer, wherein at least a part of the first layer is located in an upper portion of the comfort layer assembly when the comfort layer assembly is in a first orientation, and wherein at least a part of the second layer is located in an upper portion of the comfort layer assembly when the comfort layer assembly is in a flipped orientation; and a support core structure located below the comfort layer assembly, wherein the flippable comfort layer assembly is encased in a first fire barrier fabric rated for the first and second layers of foam or filling material which make up the flippable comfort layer assembly, wherein the support core structure is at least partially encased in a second fire barrier fabric rated for components of the support core structure, and wherein both the fire barrier encased flippable comfort layer assembly and the at least partially fire barrier encased support core structure are encased by a third fabric.

2. The mattress of claim 1, wherein the first and second fire barrier fabrics are yarn based.

3. The mattress of claim 1, wherein the fabrics are knitted.

4. The mattress of claim 1, wherein the fabrics are woven.

5. The mattress of claim 1, wherein the flippable comfort layer assembly is detachable.

6. The mattress of claim 1, wherein the third fabric is a detachable outer ticking cover assembly.

7. The mattress of claim 6, wherein the detachable outer ticking cover assembly is closeable by a zipper.

8. The mattress of claim 7, wherein the flippable comfort layer assembly at least partially encased by the first fire barrier fabric is further enclosed in a fabric pocket provided in the detachable outer ticking cover assembly.

9. The mattress of claim 1, wherein the support core structure is encased in a fabric cover.

10. The mattress of claim 9, wherein the fabric cover is fluid proof.

11. The mattress of claim 9, wherein the fabric cover is impervious to dust mites, bed bugs, or lice.

12. The mattress of claim 9, wherein the fabric cover is affixed to the support core structure with sewn seams.

13. The mattress of claim 9, wherein the fabric cover is affixed to the support core structure using sealed seams.

14. The mattress of claim 9, wherein the fabric cover is not the outermost ticking of the mattress.

15. The mattress of claim 1, wherein at least a part of the first layer is located at a top of the comfort layer assembly when the comfort layer assembly is in a first orientation, and wherein at least a part of the second layer is located at the top of the comfort layer assembly when the comfort layer assembly is in a flipped orientation.

* * * * *